United States Patent [19]

Hitchins

[11] Patent Number: 4,937,993

[45] Date of Patent: Jul. 3, 1990

[54] COMPOSITE BUILDING PANEL

[76] Inventor: William G. Hitchins, "Fiddawn", New Cascade Road, Norfolk Island, United Kingdom, 2899

[21] Appl. No.: 11,411

[22] Filed: Feb. 3, 1987

Related U.S. Application Data

[63] Continuation of Ser. No. 756,655, Jul. 19, 1985, abandoned.

[30] Foreign Application Priority Data

Jul. 19, 1984 [AU] Australia ..... PG6104

[51] Int. Cl.[5] ..... E06B 3/70; E04C 2/34; E04C 2/38

[52] U.S. Cl. ..... 52/455; 52/309.9; 52/309.14; 52/809; 52/829

[58] Field of Search ..... 52/455, 456, 785, 793, 52/809, 821, 309.7, 309.9, 309.14, 829, 830, 457, 458

[56] References Cited

U.S. PATENT DOCUMENTS

| | | | |
|---|---|---|---|
| 92,205 | 7/1869 | Mullett et al. | 52/793 |
| 505,518 | 9/1893 | Gascoigne | 52/793 |
| 1,018,896 | 2/1912 | Frey | 52/813 |
| 1,694,522 | 12/1928 | Victor | 52/785 |
| 1,917,871 | 7/1933 | Birt | 52/455 |
| 2,652,601 | 9/1953 | Slopa et al. | 52/793 |
| 3,334,464 | 8/1967 | Charles | 52/809 |
| 3,517,468 | 6/1970 | Woods | 52/809 |
| 3,823,525 | 7/1974 | Bruun | 52/785 |
| 3,946,531 | 3/1976 | Armstrong | 52/456 |
| 3,979,872 | 9/1976 | Gilchrist et al. | 52/809 |
| 4,223,500 | 9/1980 | Clark et al. | 52/821 |
| 4,236,365 | 12/1980 | Wheeler | 52/785 |
| 4,259,028 | 3/1981 | Cook | 52/785 |
| 4,270,326 | 6/1981 | Holter et al. | 52/793 |
| 4,282,687 | 11/1982 | Teleskivi | 52/809 |
| 4,327,535 | 5/1982 | Governale | 52/455 |
| 4,343,127 | 8/1982 | Greve et al. | 52/785 |
| 4,379,480 | 4/1983 | Kempel et al. | 52/809 |
| 4,463,531 | 8/1984 | Peretto | 52/785 |

FOREIGN PATENT DOCUMENTS

| | | | |
|---|---|---|---|
| 606064 | 10/1960 | Canada | 52/785 |
| 278302 | 1/1970 | Fed. Rep. of Germany | 52/793 |
| 275992 | 12/1927 | United Kingdom | 52/793 |
| 370173 | 4/1932 | United Kingdom | 52/785 |

*Primary Examiner*—Michael Safavi

[57] ABSTRACT

A building panel includes rigid side and end transverse members secured together by diagonal bracing members. Additional transverse members span the area between the side members without being affixed thereto. Areas between the side, end and additional transverse members each contain a block of foamed plastic material while opposite faces of the panel are covered by a cladding panel.

4 Claims, 3 Drawing Sheets

COMPOSITE BUILDING PANEL

This application is a continuation of prior U.S. application Ser. No. 756,655, now abandoned.

This invention relates to a composite building panel.

Many attempts have been made to devise cost effective methods of building construction, especially for domestic dwellings. This has lead to the concept of modular systems of building using pre-fabricated elements which are adapted to be assembled on site These modular systems usually include pre-fabricated composite panels for internal and external walls, adjacent panels of the structure being either joined together in edge to edge fashion or via an intermediate member which forms a stud between the top and bottom plates. Preferably the pre-fabricated elements are of lightweight construction (hence the use of composite panels) as generally speaking the lighter the material from which the structure is formed then the lighter the member supporting the structure can be with the result that a structure can be manufactured which is very economical so far as building materials are concerned.

If a structure is made of the lightest materials possible it becomes prone to the effects of high wind loadings. Most conventional methods of construction using wood, brick, stone and concrete have sufficient dead load inherent in the structure to prevent them from being severly damaged or demolished in situations of high wind loadings. The high dead load of conventional methods of construction however can, during seismic loadings, generate extremely high forces within the structure and these high forces have to be dissipated satisfactorily without undue deflection or distortion. A major advantage of a structure made of lightweight material is its resistance to seismic loadings.

Earthquakes generate ground undulations and lateral movements which impose an acceleration vertically and horizontally but more particularly horizontally. These accelerations cause the structure or the elements of the structure to be accelerated and moved laterally or horizontally though in most cases in both directions at once with the degree of acceleration and deflection being directly proportional to the mass of the structure. A light construction thus has insufficient weight to be excited by ground movement and therefore the effect upon it of seismic loading is virtually non-existent. Accordingly the amount of bracing and stiffness built into composite panels used in modular type constructions together with the connections thereof with the roofing construction and floor/foundation construction must be sufficient to ensure that small loads induced by seismic activity can be coped with and dissipated satisfactorily.

It is therefore an object of the present invention to provide a composite building panel which is able to be readily and economically constructed from lightweight building materials but is so constructed and arranged as to be able to withstand wind loadings and dissipate small loadings induced by seismic activity.

Thus, in accordance with the present invention there is provided a composite building panel comprising a parallel and spaced-apart pair of substantially rigid side members; at least one pair of substantially rigid transverse members disposed between said side members at or adjacent, respective ends thereof and normal thereto; a body portion of foamed plastic material accommodated within the area defined by said side and transverse members; a cladding panel overlying each face of said body portion; and a pair of bracing members, of thin cross-section and high tensile strength. disposed between at least one of said cladding panels and said body portion, said bracing members extending between diagonally-opposed corners defined by said side and transverse members and being affixed to said members at the said corners thereof.

Preferably, there are additional, substantially rigid transverse members disposed between the side members intermediate the said at least one pair of transverse members.

In order that the reader may gain a better understanding of the present invention, hereinafter will be described certain preferred embodiments thereof, by way of example only, and with reference to the accompanying drawings in which.

Figure 2:
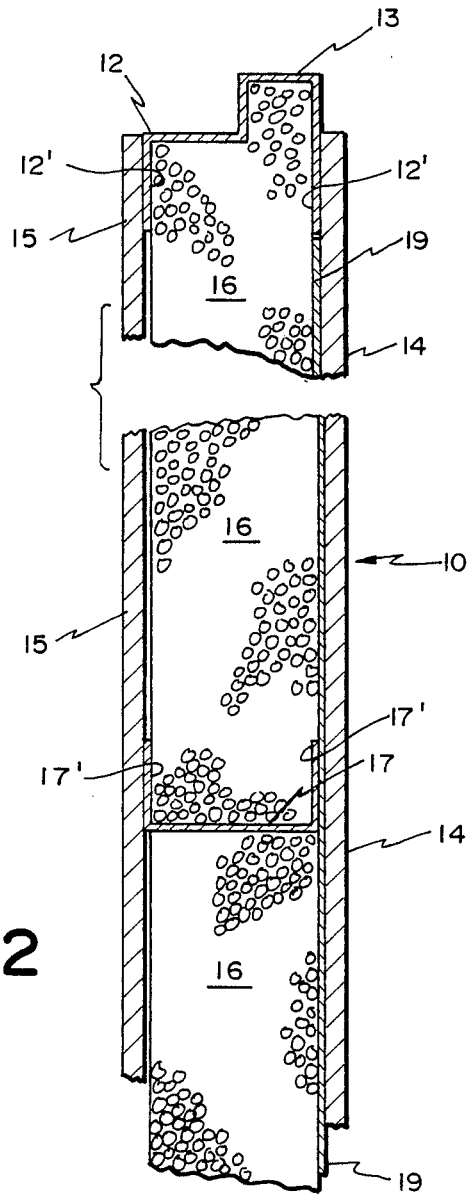
FIG. 2 is a fragmentary side view of the composite panel shown in FIG. 1 but drawn to a larger scale, with the side member removed for clarity.

The panel 10 in its preferred embodiment is formed from a pair of rigid side members 11 which are formed from extruded aluminium and are preferably of such a cross-sectional shape that the side member 11 of one panel can mate with the side member of another panel. In the preferred form the side members 11 are such that they mate in a snaplock fitting arrangement so that a positive connection between adjacent panels is formed. Extending between the ends of the side members 11 are transverse members 12 which are once again of extruded aluminium construction. In the preferred form of construction the two end transverse members 12 are not fastened directly to the side members 11. Also according to the preferred form of the invention and as more clearly shown in FIG. 2 the cross-sectional shape of each end transverse member 12 comprises a channel configuration having opposed flange portions 12'—12' as well as a tongue portion 13 which can fit into a suitably dimensioned and shaped recess in an extruded aluminium element which forms the top and bottom plates of a modular building construction system.

Each side of the frame which is effectively formed by the side members 11 and end transverse members 12 is clad with a panel 14 and 15. Where the composite panel 10 is to form an exterior wall the panel 15 (which in use of the composite panel 10 will form the outer surface cf the building construction) is formed by a manufactured cement panel such as fibrous cement. The panel 14 which is to form the inner wall surface of the wall is in the preferred form of the invention constructed from a manufactured panel such as gibralta board or a particle board. Panels 14 and 15 are pop riveted to the side members 11 and end transvrse members 12.

Sandwiched between the two panels 14 and 15 may be one or more body portions or blocks 16 of a foamed plastic material. In the form of the panel illustrated in FIG. 1 three such blocks 16 are incorporated and these blocks are preferably of a polystyrene foam. Additional transverse members 17 are located between adjacent blocks 16 and in the preferred form of the invention these transverse members 17 are of channel cross-section with the distance between the flanges 17'—17' thereof being sufficient to enable the edge of one block to be inserted therein. Once again in the preferred form of the invention these transverse members are not mechanically fastened to the side members 11.

The panel is completed by one or two sets of bracing members 18. This cross bracing 18 is formed by a pair of thin cross-section straps 19 constructed from a high-tensile material such as steel or a plastic or composite plastic strap. The members 19 are pop riveted at their ends to the corners C of the panel formed by the side members 11 and transverse members 12 and are also fastened along their lengths to the transverse members 17. Once again it is preferred that the method of attachment is by pop riveting. Where the panel is for an external wall and thus the outside panel 15 is of a cement construction, then bracing members are not provided on that side of the frame so as to ensure that undue distortion of the panel 15 does not occur.

The composite panel 10 is of a very straightforward construction and according to the preferred method of manufacture is built within a jig. By means of this method of construction one of the panels, say cladding panel 15, is laid within the jig and then placed on top of that panel but within the confines of the jig are the side members 11 and end transverse members 12. The inside face of the cladding panel is then coated with a contact adhesive as are the facing surfaces of the polystyrene blocks 16 whereupon the two end blocks are placed in position and preferably these have engaged thereon the transverse members 17. The central block 16 is then placed in position. The bracing members or straps 19 are then laid in position and drilled and pop riveted to the corners and transverse members. No pretensioning of the members 19 is required. The upwardly facing surfaces of the block 16 are then coated with a further contact adhesive and the facing or cladding panel 14 is placed in position. Following this the facing panel 14 is pop riveted to the aluminium side and end transverse members 11, 12 following which the panel is removed from the jig, turned over and the panel 15 then pop riveted to the aluminium side and transverse members to thereby complete construction of the panel.

Figure 1:
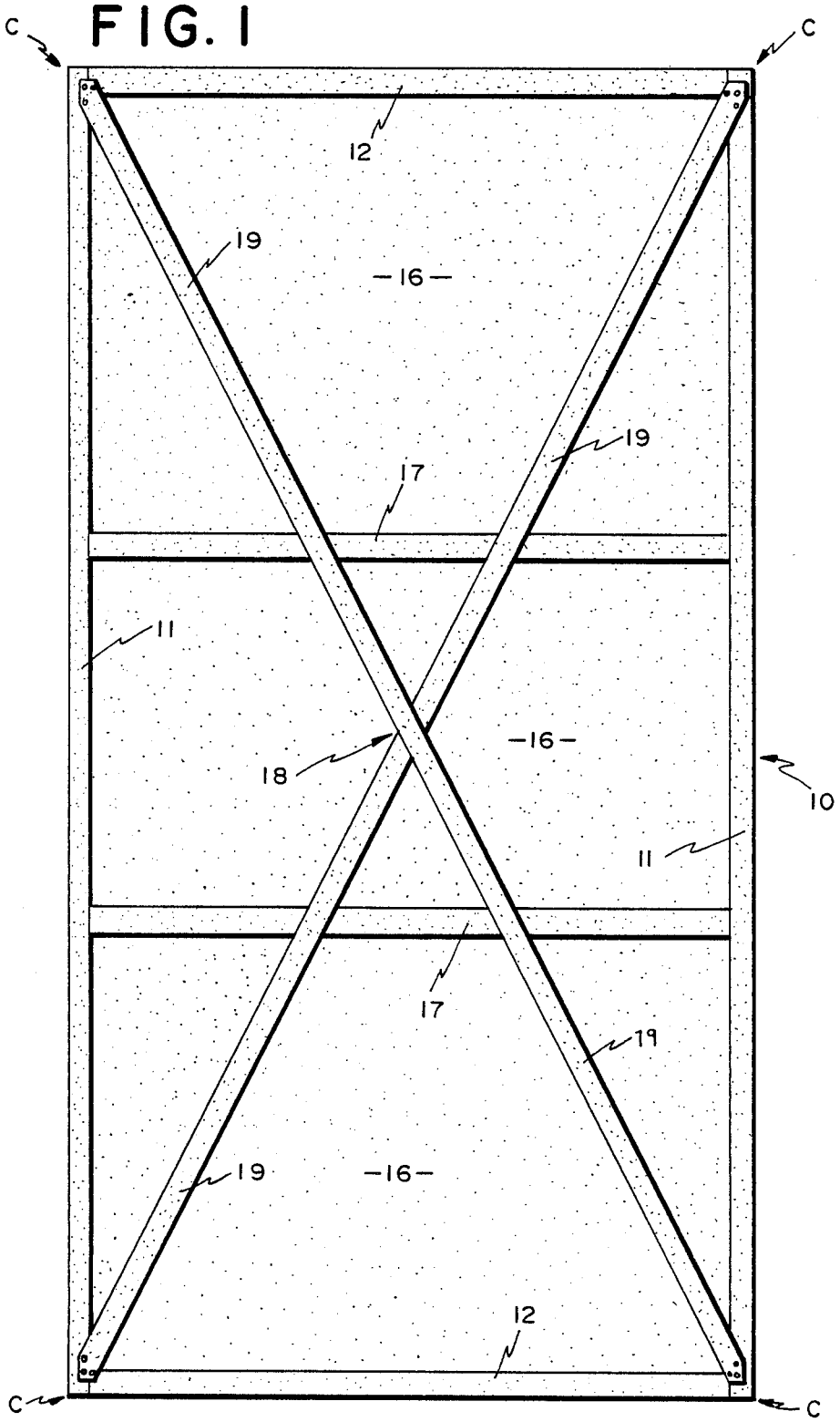
FIG. 1 is a plan view of one form of the composite panel, with a cladding panel removed.
Figure 3:
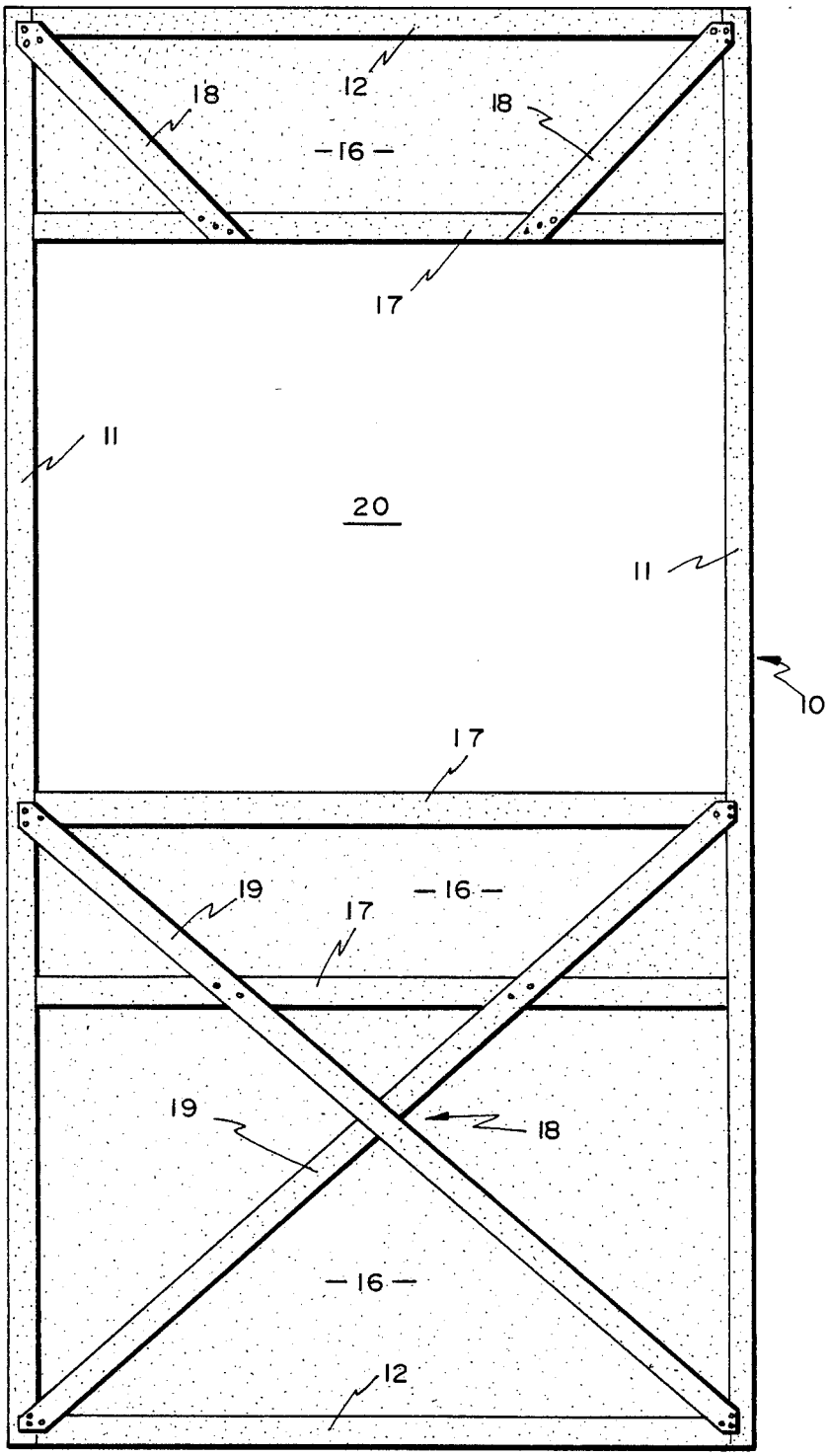
FIG. 3 is a plan view of a further form of the composite panel, again with a cladding panel removed.

It will be appreciated by those skilled in the art that when the panel is used in a modular building system the panel shown in FIG. 1 forms a basic wall panel without any so-called "reveals" for windows or doors. The construction of the panel can readily be modified so as to provide such reveals and reference is made to FIG. 3 of the drawings wherein a panel suitably modified is provided with reveal 20 for a window frame to be inserted therein.

The composite panel according to the present invention is most suited for a modular type building construction using lightweight materials. For example the construction can be formed primarily from aluminium material and manufactured panels. The roof trusses, top and bottom plates, floor bearers and joists can all be formed from aluminium componentry of suitable dimensions and cross-sectional configurations. The construction panels are butted together preferably in a locking arrangement so that the side members 11 of adjacent panels effectively combine to form studs. In the finished construction continuous bolts extend from the foundation to the trusses and these bolts are tensioned when the structure is fully erected so as to preload or prestress the wall panels 10 to ensure that wind load uplift is carried without the initial deflection which normal modes of construction have to develop before they can carry the wind load. The bracing and stiffness built into the panels 10 together with the bracing and the connections formed by the continuous bolts between the trusses and foundations ensure that small loads induced by seismic activity are coped with and dissipated without any undue deflection or distortion taking place.

The composite panel according to the present invention is of lightweight construction, can be readily and quickly constructed and is economic so far as use of materials and labour is concerned. Nonetheless, the particular construction and arrangement of the panel ensures that the panel can be employed in situations where high wind loadings are experienced and it is able to dissipate small loads induced by seismic activity.

From the abovegoing, the reader will readily appreciate that composite building panels made in accordance with the present invention will provide the public with a new or much-improved building component or, at the very least, offer to it a useful and attractive choice.

The claims defining the invention are as follows:

1. A composite, load-bearing building panel comprising a parallel and spaced-apart pair of substantially rigid end transverse members disposed between a pair of side members adjacent respective ends thereof and normal thereto; a plurality of substantially rigid additional transverse members extending between said side members and disposed normal thereto, said transverse members defining separate adjacent areas within said building panel; a block of foamed plastic material disposed within each of said areas, each end and additional transverse member being formed with a channel-shaped cross-section having opposed flange portions engaging said blocks of foamed plastic material; a cladding panel overlying each side of the composite building panel; and a pair of bracing members, of thin cross-section and high tensile strength, disposed between at least one of said cladding panels and said blocks of foamed plastic material, said bracing members extending between diagonally-opposed corners defined by said side and end transverse members:

characterized in that each of said additional transverse members has opposed ends which only abut said side members and are free of any fastening means thereto; and in that said bracing members are pop-riveted to said side and end transverse members at the corners thereof, and to said additional transverse members, whereby the composite, load-bearing building panel is able to withstand wind loadings and to dissipate small loadings induced by seismic activity.

2. The composite, load-bearing building panel as claimed in claim 1, wherein said cladding panels are pop-rivetted to said additional transverse members.

3. The composite, load-bearing building panel as claimed in claim 2, wherein each said end transverse member includes an elongated tongue portion extending along the length thereof, each tongue portion being adapted to co-operate with a corresponding recess in a top or bottom plate of a building construction.

4. The composite, load-bearing building panel as claimed in claim 3, wherein said panel is provided with a reveal for the insertion of a window frame therein.

* * * * *